US006272711B1

(12) United States Patent
Ignacio

(10) Patent No.: US 6,272,711 B1
(45) Date of Patent: Aug. 14, 2001

(54) MULTIFUNCTION SURFACE ENGAGING APPARATUS THAT IS PARTICULARLY SUITED IN REMOVING SNOW AND ICE

(76) Inventor: Dante Ignacio, 3816 Tennessee Dr., Rockford, IL (US) 61108

( * ) Notice: Subject to any disclaimer, the term of this patent is extended or adjusted under 35 U.S.C. 154(b) by 0 days.

(21) Appl. No.: 09/290,950

(22) Filed: Apr. 13, 1999

(51) Int. Cl.[7] ..... A46B 13/02
(52) U.S. Cl. ..... 15/4; 15/21.1; 15/22.3
(58) Field of Search ..... 15/4, 21.1, 22.3

(56) References Cited

U.S. PATENT DOCUMENTS

| | | | | |
|---|---|---|---|---|
| D. 286,737 | | 11/1986 | House, II et al. . | |
| 3,146,475 | * | 9/1964 | Balitsky | 15/4 |
| 3,252,175 | * | 5/1966 | Pedersen | 15/22.3 |
| 5,221,229 | | 6/1993 | Brophy . | |
| 5,251,351 | | 10/1993 | Klotz . | |
| 5,309,597 | | 5/1994 | Wymore . | |
| 5,495,632 | | 3/1996 | Baker . | |
| 5,809,602 | | 9/1998 | Kitchens . | |
| 5,834,154 | | 10/1998 | Yamazaki et al. . | |

* cited by examiner

*Primary Examiner*—Randall E. Chin
(74) *Attorney, Agent, or Firm*—Leydig, Voit & Mayer, Ltd.

(57) ABSTRACT

A multifunction apparatus for engaging a surface is particularly suited for removal of snow and ice from the windshields and hoods of vehicles. The apparatus includes a support frame having two pulleys and a handle for manipulating the apparatus. An endless belt is entrained on the pulleys for movement along a continuous path. A bi-directional electrical motor is mounted on the frame and has forward and reverse modes for driving the endless belt along the continuous path. A plurality of surface engaging device assemblies having a first end connected to the endless belt and a second end extending outward from the endless belt provide for the multifunction operational modes. More specifically, each surface engaging device assembly includes first and second heads such as a scraper for removing ice and a brush for removing snow. A trip mechanism carried on the support frame cooperates with the electric motor to switch the location of the heads at the outer periphery of the endless belt to selectively cause the first head to engage the surface or alternatively the second head to engage the surface.

19 Claims, 6 Drawing Sheets

26
24
20
92
86
80
48
50
52
60
58
99
84
85
88

MULTIFUNCTION SURFACE ENGAGING APPARATUS THAT IS PARTICULARLY SUITED IN REMOVING SNOW AND ICE

FIELD OF THE INVENTION

The present invention relates generally to surface engaging apparatus and more particularly to surface engaging apparatus for brushing, scraping, scrubbing, wiping, cleaning, engaging and the like.

BACKGROUND OF THE INVENTION

Removal of snow and ice from vehicles with conventional ice scrapers and brushes is a particularly arduous task that is often accomplished under cold uncomfortable conditions. Scraping ice requires one to exert a downward force on a scraper while sliding the scraper across the windshield. Brushing snow requires one to reciprocate a brush back and forth to remove the snow from the hood and windshield. Due to the size of vehicles and reach of typical persons, there are often places that cannot be reached or that are difficult to reach while applying the force and motion necessary for removing snow and ice. Moreover, the manual manipulation of conventional scrapers and brushes often results in snow and ice ending up on the person's clothing, which provides a disincentive for removing snow and ice from large areas and hard to reach areas. These factors often result in a less than satisfactory removal of snow and ice from vehicles which presents a potential operational hazard.

In other related applications, motorized surface engaging apparatus for scrubbing, sweeping, cleaning and engaging are generally known such as those shown, for example, in U.S. Pat. Nos. 5,495,632, 5,221,229, 5,309,597, 5,809,602. These patents generally disclose that a surface engaging head mounted on a carrier can be motorized to reduce manual labor necessary for engaging a surface. As disclosed in U.S. Pat. No. 4,495,632, different cleaning heads can be interchangeably attached to the end of the motorized apparatus. However, changing heads takes time and often tools to change the heads. Moreover, idle heads can often be misplaced or lost when not attached to the motorized apparatus.

SUMMARY OF THE INVENTION

According to one of the aspects of the present invention, the present invention provides a multifunction motorized apparatus for engaging a surface that has particular application to removal of snow and ice from vehicles but may also be used in other surface engaging applications. The apparatus includes a support frame having two pulleys mounted thereon and a handle for manipulating the apparatus. An endless conveyor is entrained on the pulleys for movement along a continuous path. A motor is supported by the frame and is drivingly connected to the endless belt for driving the endless belt along the continuous path. A plurality of surface engaging device assemblies have an inner end connected to the endless belt and an outer end extending outward from the endless belt for engaging a surface such as a windshield of a vehicle for example. Each surface engaging device assembly includes a movable body having first and second surface engaging heads which can be alternatively located at the outer end for engaging the surface. It is an advantage that each head provides a different operating mode for the surface engaging apparatus. For example, one head can be a brush while the other head may be a scraper such that the scraper heads are located at the outer end for scraping ice and the brush heads are located at the outer end for brushing snow.

According to one of the aspects of the present invention, a multifunction apparatus for engaging a surface comprises a support frame having two pulleys and a handle for manipulating the apparatus. An endless belt is entrained on the pulleys for movement along a continuous path. A bi-directional electrical motor supported by the support frame has reverse and forward modes for driving the endless belt along the continuous path. A plurality of surface engaging device assemblies have an inner end connected to the endless belt and an outer end extending outward from the endless belt for engaging the surface. Each surface engaging device assembly includes first and second surface engaging heads. A trip mechanism carried on the support frame cooperates with the electric motor. The trip mechanism includes a movable body having first and second contact surfaces for engaging the movable body in the forward and reverse modes to selectively locate the first and second heads at the outer end for engaging a surface.

According to yet one other aspect of the present invention, a surface engaging device assembly for use with a surface engaging apparatus that includes a movable carrier comprises a movable body having first and second surfacing engaging heads for engaging a surface. The movable body includes a pivot axis. The surface engaging device assembly further includes a mounting bracket that is connectable to the movable carrier. The movable body is pivotably connected to the mounting bracket. The movable body is pivotable between a first position in which the first head projects outward from the bracket for engaging a surface and a second position in which the second head projects outward from the bracket for engaging a surface.

These and other aims, objectives, and features of the invention will become more apparent from the following detailed description when taken in conjunction with the accompanying drawings.

Figure 1:
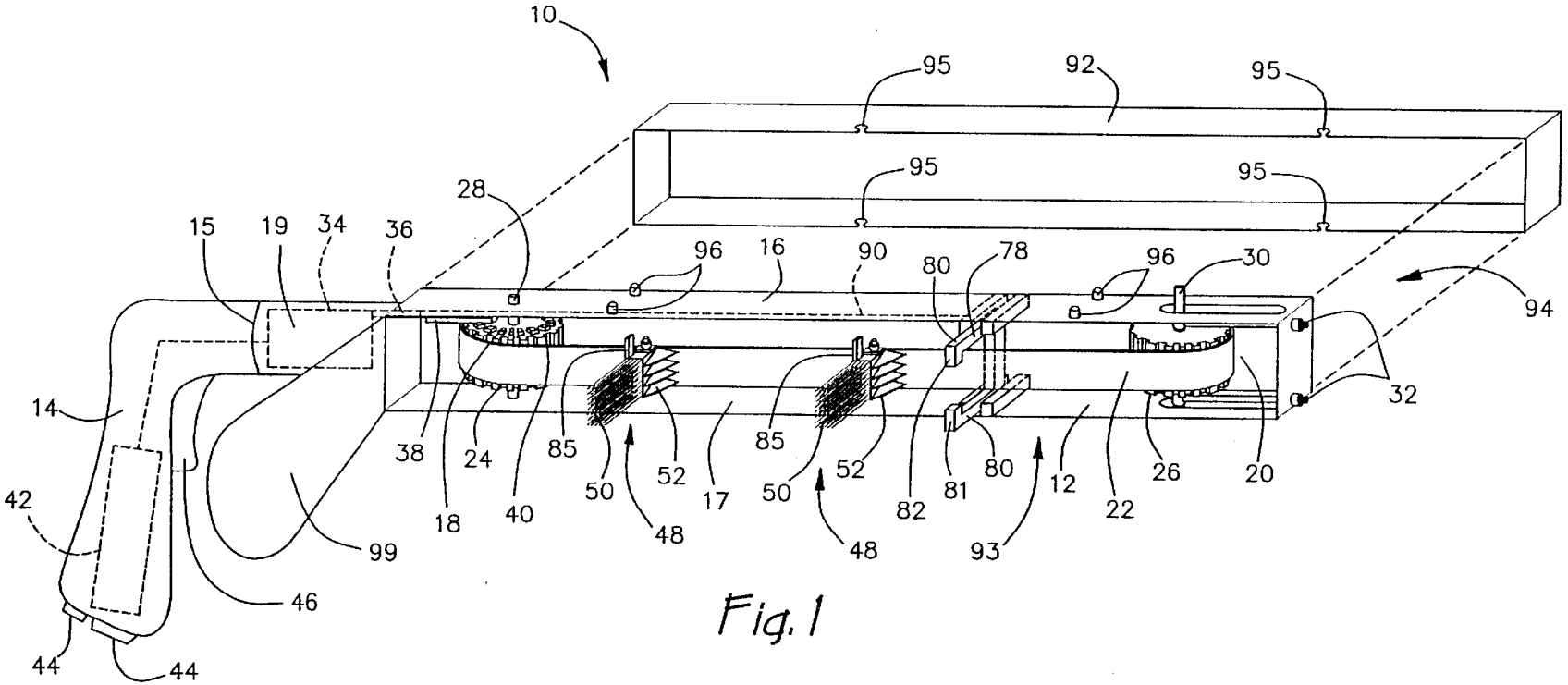
FIG. 1 is a perspective view of a surface engaging apparatus according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring to FIG. 1, a multifunction surface engaging apparatus is illustrated in the form of a combination ice scraper and brushing apparatus 10, in accordance with a preferred embodiment of the present invention. A support frame 12 with a handle 14 connected thereto provides structure for manipulating the apparatus 10. The handle 14 may be pivotably connected to the rest of the frame 12 at an area indicated at 15 so that the handle 14 may pivot 180° and be locked in at either a right hand position or a left hand position to allow the apparatus 10 to be more easily used by both right handed and left handed individuals. The frame 12 generally includes first and second parallel sides 16, 17 and a motor housing 19 connected to the handle 14.

A pair of spaced apart pulleys 18, 20 are mounted on the frame 12 and have entrained thereon an endless belt 22 for movement along a continuous path. The pulleys 18, 20 are provided by a pair of wheels 24, 26 mounted for rotation with respect to the frame 12 by axles 28, 30, but may also alternatively be provided by fixed low friction rods, or other appropriate pulley mechanism. The axles 28, 30 extend transversely between the frame sides 16, 17. The tension in the belt 22 may be controlled by adjusting a tension adjusting device 32 which adjusts the spacing between the first and second wheels 24, 26 by moving the axle 30 of the second wheel 26. It is an advantage of controlling the tension that a tighter tension may be used for engaging more planar surfaces and a looser tension may be used for engaging slightly curved surfaces.

A motor 34 mounted in the motor housing 19 is drivingly connected to the endless belt 22 or other carrier for driving the endless belt 22 between the pulleys 18, 20 along the continuous path. The motor 34 has a rotary output on a drive shaft 36 that is transferred to the first wheel 24 through a pair of meshing gears 38, 40 which are affixed to the drive shaft 36, and first wheel 24, respectively. The motor 34 is preferably electrically powered by a rechargeable battery 42 that may be mounted in the handle 14, or a external power supply through an electrical input 44, such as a adapter and cord connecting the input 44 to the cigarette lighter output of a car for example, but may also be pneumatically powered for example if the application allows. The motor 34 is actuated by a trigger 46 located in a convenient location on the handle 14. Depending upon the application, it will be appreciated that there are other ways of drivingly connecting the endless belt 22 and the motor 34, such as mounting the motor 34 on one of the frame sides and connecting it directly to one of the axles 28, 30 or to a separate drive wheel between the two frame sides 16, 17.

In accordance with the present invention, the apparatus 10 includes a plurality of surface engaging device assemblies 48 that include two different surface engaging heads 50, 52 for two different operating modes and surface engaging functions. In the present embodiment, pairs of heads 50, 52 are fixed with one another in pivotable bodies 54 that are pivotably connected to respective mounting brackets 56. Each bracket 56 connects one end 58 of the engaging device assembly 48 to the belt 22 via rivets 59 or other connector. One of the heads 50 is located at a second outer end 60 of the engaging device assembly 48 for engaging a surface while the other head 52 is disposed between the ends 58, 60 so as not to engage the surface. Each pivotable body 54 is pivotably connected to the bracket 56 by a pin 62. The pin 62 is slidably disposed in a slot 64 formed in the bracket 56 such that the pivotable bodies 54 can be moved towards or away from the belt 22. A spring 65 or other resilient means such as a rubber piece urges each pivotable body 54 against the belt 22 relatively tightly. The spring 65 may be disposed in the slot 64 to apply force directly on the pin 62 to bias the pin 62 towards the end of the slot 64 which is closest to the belt 22.

Figures 2, 3, 4:
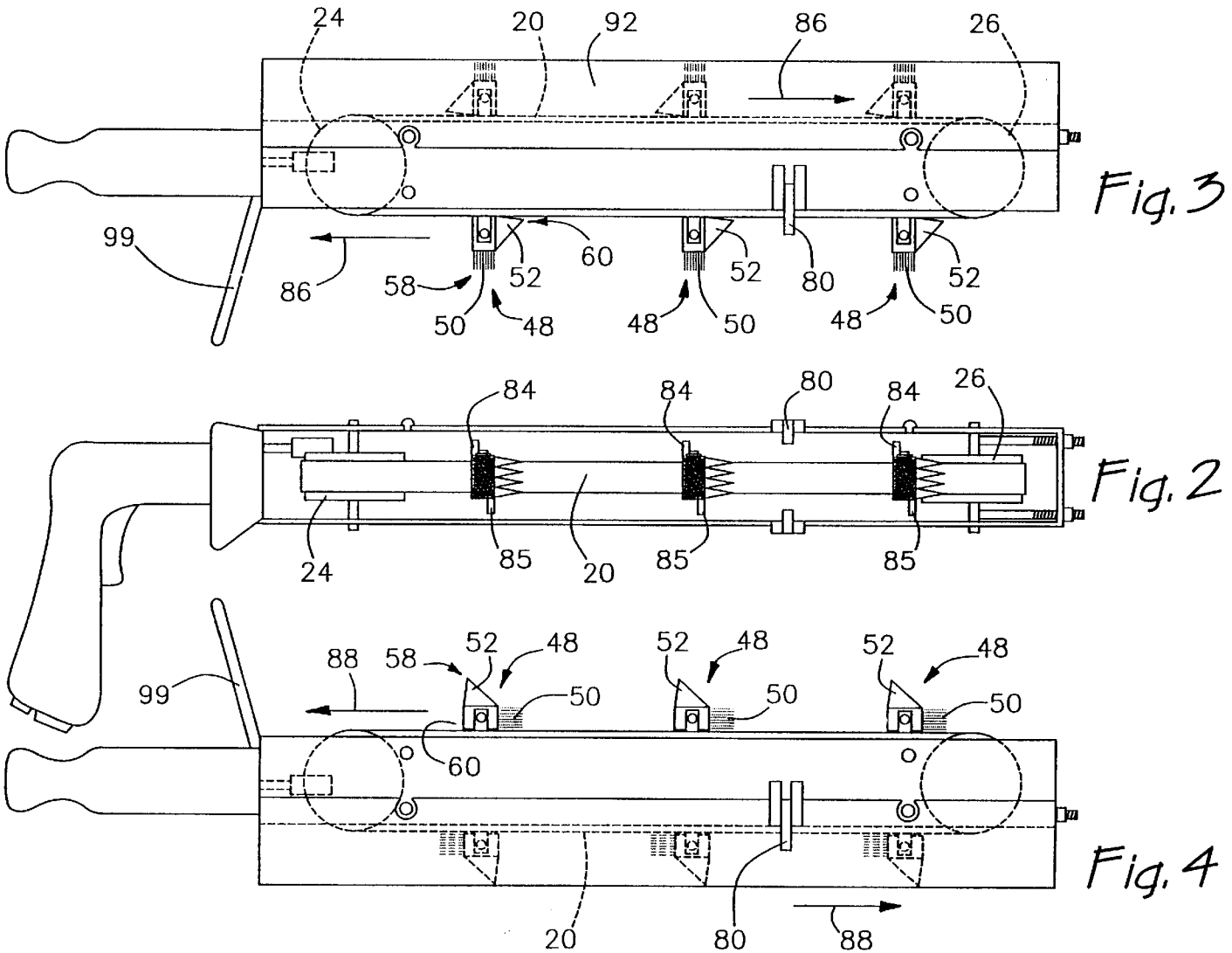
FIG. 2 is a side view of FIG. 1.
FIG. 3 is a top view of FIG. 1 illustrated in a first position and a first operational mode.
FIG. 4 is a diagrammatic top view of FIG. 1 illustrated in a second position and a second operational mode.
Figure 5:
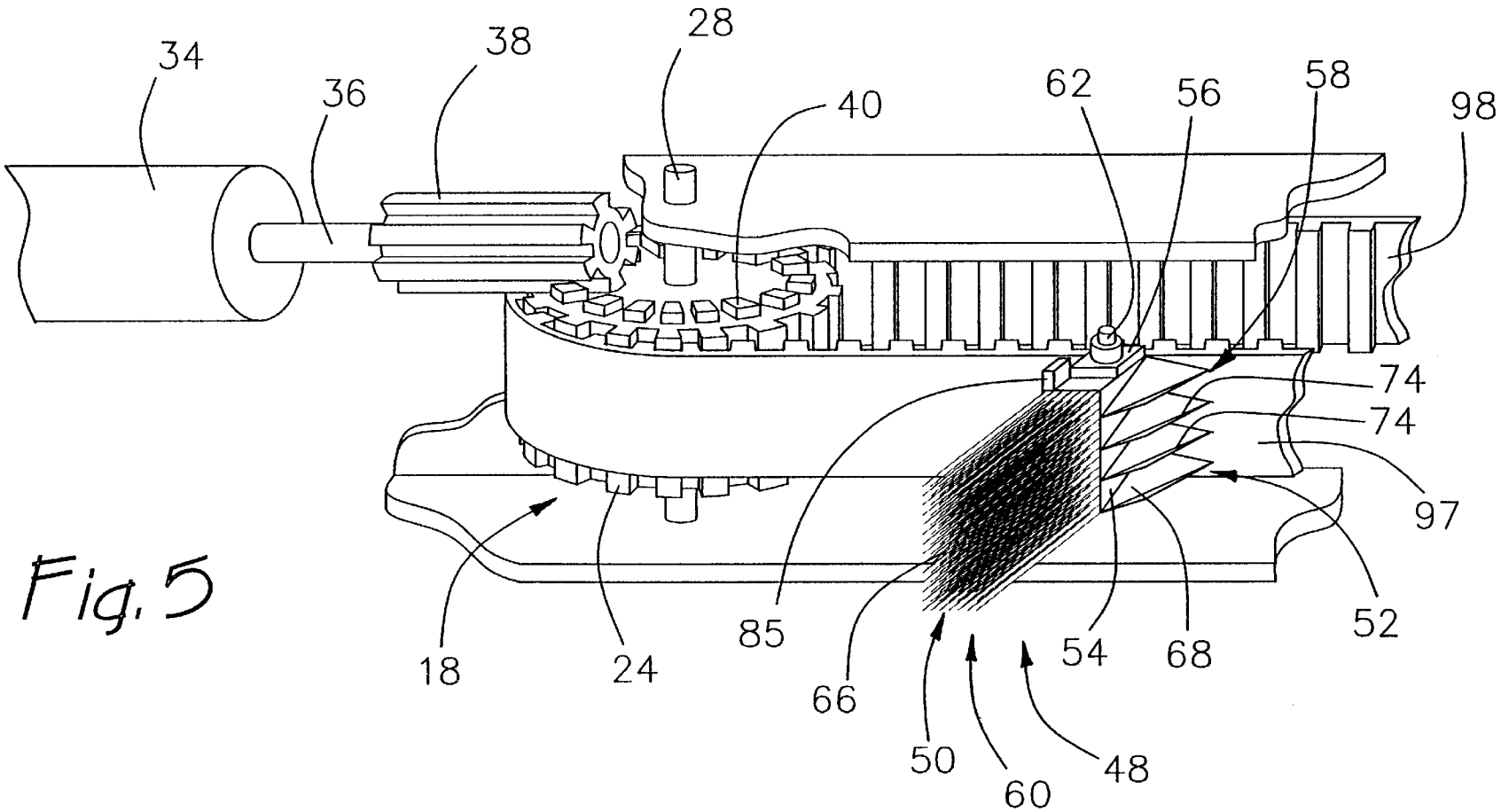
FIG. 5 is an enlarged partially fragmentary perspective view of parts shown in FIG. 1.
Figure 8:
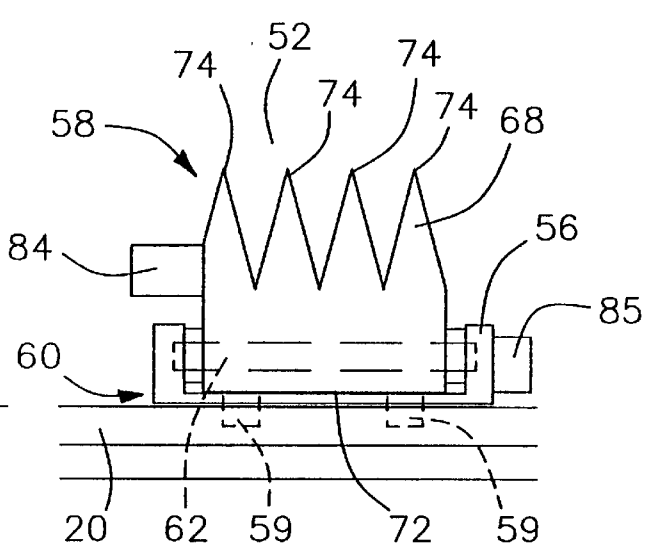
FIGS. 6–8 are fragmentary front, top, and side views of the surface engaging assemblies shown in FIG. 1.
Figure 7:
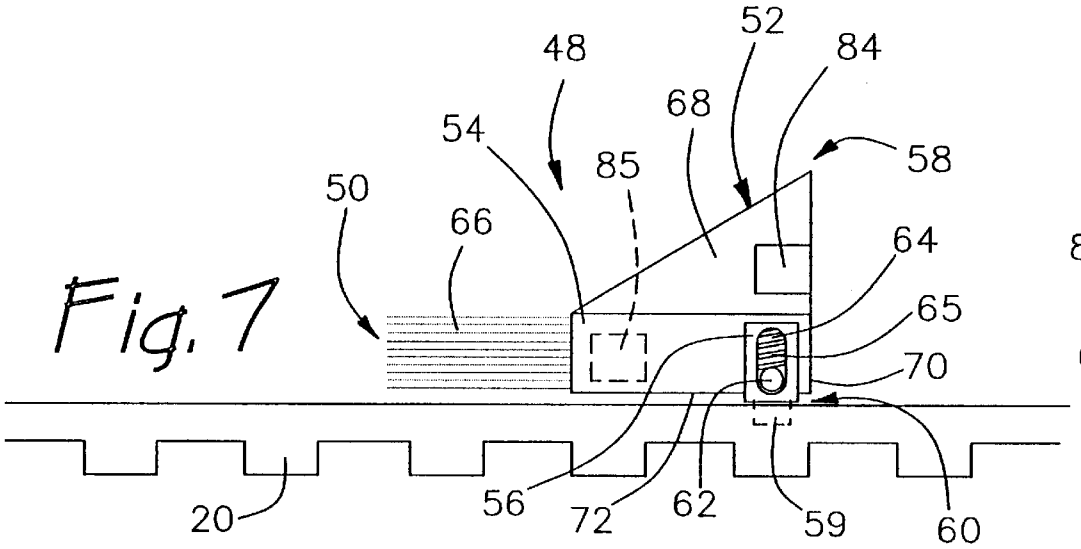
Figure 6:
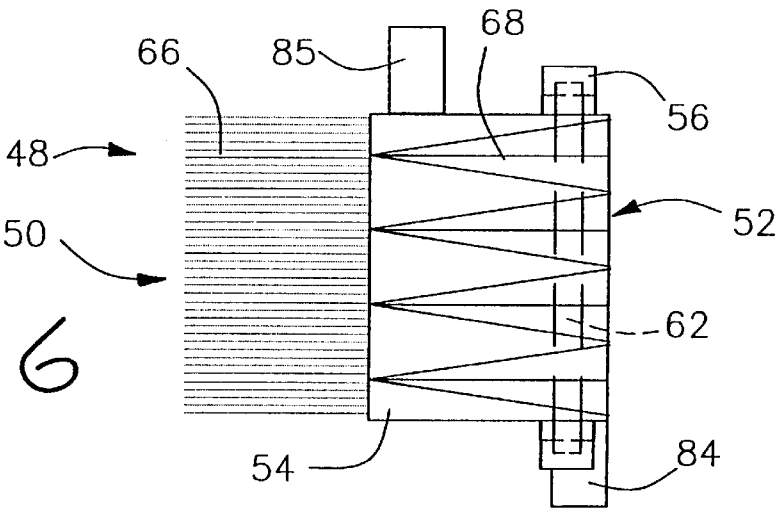

As seen by comparing FIGS. 3 and 4, the pivotable body 54 can be partially rotated between a first position wherein the first head 50 is located at the outer end 60 as shown in FIG. 3, and a second position wherein the second head 52 is located at the outer end 60. In the present embodiment, the first head 50 is a relatively flexible brush 66 for removing snow while the second head 52 is a relatively rigid scraper 68 for scraping ice. The scraper 68 includes a relatively rigid support portion having first and second seating surfaces 70, 72 that alternatively seat against the belt 22 under the action of the spring 65 to hold the single body in either the first or second engaging position during use. Some of the scrapers 68 may include teeth 74 for engaging the surface while other scrapers 68 may include a straight edge (not shown) for engaging the surface. It will be appreciated that other such surface engaging heads may be also used such as cleaning, scrubbing, wiping, buffing, or other appropriate surface engaging head as appropriate for the surface engaging application.

To switch the surface engaging device assemblies 48 between first and second positions, the present embodiment includes a tripper mechanism 78 mounted on the frame 12. The tripper mechanism 78 includes a movable arm 80 that is movable between first and second positions. The arm 80 includes a pair of tabs 81, 82 that provide contact surfaces for engaging a pair of ears 84, 85 that provide contact surfaces on the pivotable body 54 in order to switch the position of the heads 50, 52 of the pivotable body 54 with respect to the belt 22. In the present embodiment, the motor 34 is bi-directional and each direction corresponds to one of the positions of the pivotable body 54. More specifically, in FIG. 3, the motor 34 is being operated in a forward mode indicated by arrow 86 while in FIG. 4, the motor 34 is being operated in a reverse mode indicated by arrow 88. When the motor is first operated in the forward mode (after previously being operated in reverse mode), each pivotable body 54 is sequentially switched to expose the first head as each body 54 passes the tripper mechanism 78. During switching, the first tab 81 engages the first ear 84 to flip the position of the pivotable body 54 so that the first head 50 and brushes 66 are exposed at the end 58, as shown in FIG. 3. The pivotable body 54 will both linearly translate in the slot 64 and rotate during the flipping action. When it is desired to expose the second head 52 and scrapers 68 at the outer end 60, the position of the arm 80 is moved to align the second tabs 82 with the second ears 85 and the operating mode of the motor 34 is reversed to provide a reverse flipping action in reverse sequence to the pivotable bodies 54, thereby locating the second head 52 and scrapers 68 at the outer end 60 as shown in FIG. 4. It is an advantage of this configuration that two operational modes are achieved. In the preferred application of removing snow and ice, the brushes 66 can be exposed to first remove snow, then the scrapers 68 can be exposed to scrape ice, and then the brushes 66 can be exposed again if desired to remove the scraped ice. The belt 22 accomplishes a long linear swap over the surface to efficiently remove snow and ice or other such debris.

Figure 10:
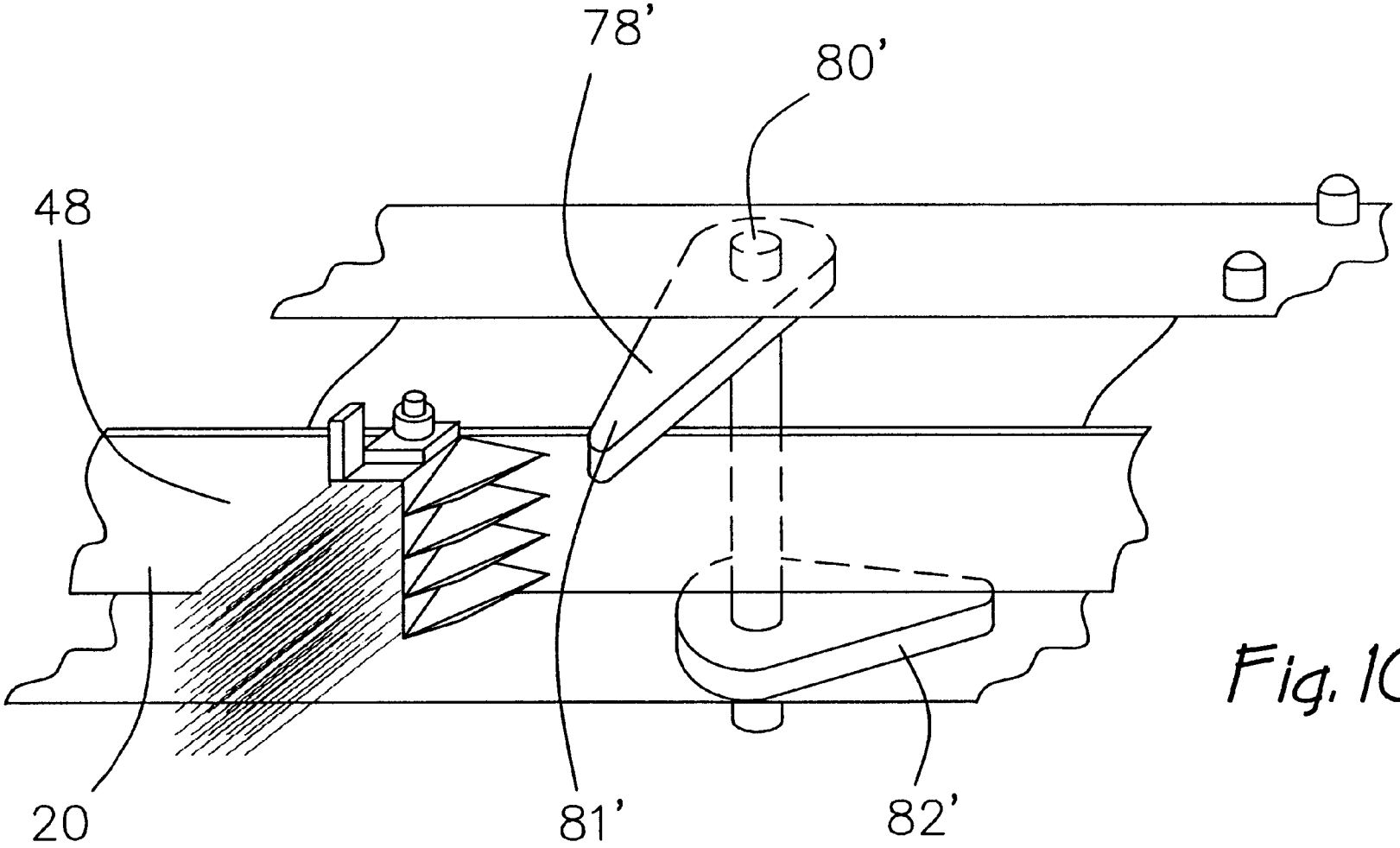
FIG. 10 is an alternative embodiment for certain parts illustrated in FIG. 1.

The direction of the motor 34 may be accomplished through mechanical or electrical feedback 90 from the tripper mechanism 78 or may be manually controlled through the trigger 46, or other appropriate control. The tripper mechanism 78 of the present embodiment includes a linearly translatable arm 80. With reference to FIG. 10, it will be appreciated that other tripper mechanisms may be used such as a tripper mechanism 78' that includes a rotatable arm 80' for pivoting a pair of tabs 81', 82' that similarly alternatively engage ears on pivotable bodies.

Referring to FIG. 1, the apparatus 10 may include a hand guard cover 92 that is connectable to the frame 12 for covering one of the rear and front open sides 93, 94 of the frame 12 between the frame sides 16, 17. The cover 92 includes latch springs 95 that latch on to latch posts 96 on the support frame 12. The cover 92 selectively covers one of the side segments 97, 98 of the belt 22 for safety purposes and to prevent material such as snow and ice from being expelled onto the operator of the apparatus 10. The cover 92 can be latched over front open side 93 in one operational mode and alternatively over the rear open side 94 in the other operational mode if so desired. The apparatus may also include a shroud 99 that is mounted for rotation on the frame 12 between the belt 22 and the handle 14 for preventing material from hitting an individual's hand that is operating the trigger 46. The shroud 99 can be locked into a selected angular place as desired to most effectively deflect debris.

Figure 9:
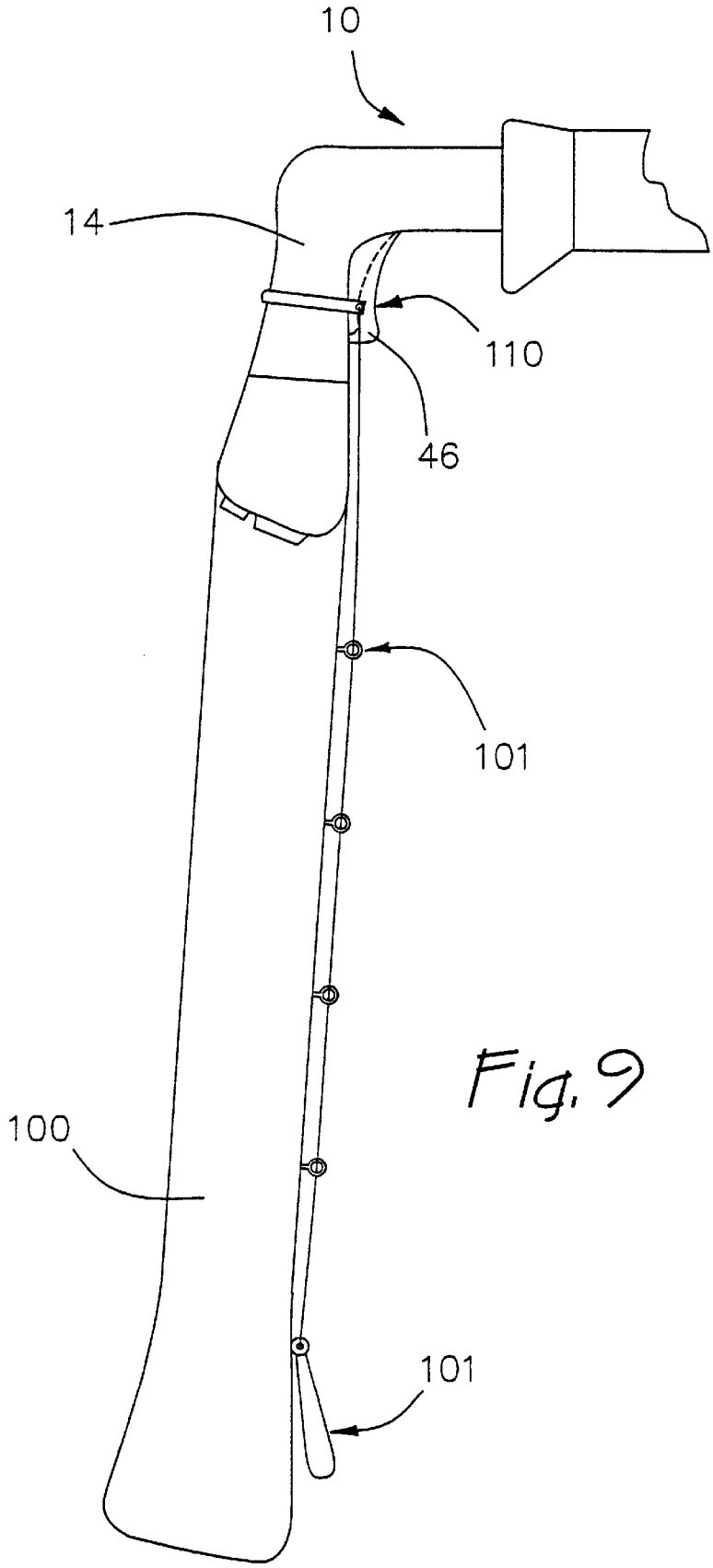
FIG. 9 is an extension handle for use with the preferred embodiment of FIG. 1.

Referring to FIG. 9, a extension handle 100 may be attached to the handle 14 to allow the apparatus 10 to reach high spots such as the top of a van or a hood of a semi-truck. A trigger assembly 101 may be used to engage the trigger 46 at linkage 110 and extend the actuating trigger 46 to a more convenient location.

While a preferred embodiment is shown herein, it will be appreciated that the apparatus 10 and surface engaging device assemblies 48 of the present invention may be adapted into other tools for other applications which utilize more than one engaging head for engaging surfaces. Certain broader claims appended hereto are meant to include these broader applications.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A multifunction apparatus for engaging a surface, comprising:

a support frame having a handle for manipulating the apparatus;

two pulleys carried by the support frame;

an endless belt entrained on the pulleys for movement along a continuous path;

a motor supported by the support frame, drivingly connected to the endless belt for driving the endless belt along the continuous path;

a plurality of surface engaging device assemblies having an inner end connected to the endless belt and an outer end extending outward from the endless belt for engaging the surface, each surface engaging device assembly including a movable body, the surface engaging device assembly having first and second engaging heads, each movable body having first and second positions, the first head being located at the outer end in the first position for engaging the surface, the second head being located at the outer end in the second position for engaging the surface.

2. The multifunction apparatus of claim 1 wherein the motor is an electrical motor, the electrical motor being bi-directional having forward and reverse modes correspondingly driving the belt in opposing directions, the first heads being located at the outer end in the reverse mode, the second heads being located at the outer end in the forward mode.

3. The multifunction apparatus of claim 2 further including a trip mechanism carried on the support frame cooperating with the electrical motor, the trip mechanism engaging the surface engaging device assemblies in the forward mode to locate the first head at the second end, the trip mechanism engaging the surface engaging device assemblies in the reverse mode to locate the second head at the second end.

4. The multifunction apparatus of claim 1 wherein the surface engaging device assemblies including a plurality of mounting brackets fixed to the endless belt, the movable bodies being pivotably connected to the mounting brackets, respectively.

5. The multifunction apparatus of claim 4 wherein each bracket includes a slot, each movable body being pivotably connected to the bracket by a pin, the pin being linearly translatable in the slot, and further including resilient means urging each movable body towards the endless belt.

6. The multifunction apparatus of claim 1 wherein the first head is a brush adapted for brushing snow and the second head is a scraper adapted for scraping ice.

7. The multifunction apparatus of claim 1 further comprising a cover selectively connectable to first and second sides of the support frame, the first and second sides of the support frame exposing opposing segments of the endless belt, respectively, the cover adapted to cover the opposing segments of the endless belt.

8. The multifunction apparatus of claim 7 further comprising a movable shroud connected to the support frame between the handle and the endless belt, the movable shroud having first and second positions corresponding to the position of the cover for deflecting debris.

9. The multifunction apparatus of claim 1 wherein the handle is selectively rotatable on the support frame between left and right handed positions to allow for left handed and right handed users, the handle adapted to be locked into the left and right handed positions.

10. The multifunction apparatus of claim 1 further comprising a extension handle connectable to the handle for extending the reach of the multifunction apparatus.

11. A multifunction apparatus for engaging a surface, comprising:

a support frame having a handle for manipulating the apparatus;

two pulleys supported by the support frame;

an endless belt entrained on the pulleys for movement along a continuous path;

a bi-directional electrical motor supported by the support frame, having reverse and forward modes, drivingly connected to the endless belt for driving the endless belt along the continuous path;

a plurality of surface engaging device assemblies having a first end connected to the endless belt and a second end extending outward from the endless belt for engaging the surface, each surface engaging device assembly including a movable body having first and second heads for engaging surfaces;

a trip mechanism carried on the support frame cooperating with the electrical motor, the trip mechanism including a first contact surface engaging the movable body in the forward mode to locate the first heads at the second ends, the trip mechanism including a second contact surface engaging the movable body in the reverse mode to locate the second heads at the second ends.

12. The multifunction apparatus of claim 11 wherein the surface engaging device assemblies including a plurality of mounting brackets fixed to the endless belt, the single bodies being pivotably connected to the mounting brackets, respectively.

13. The multifunction apparatus of claim 12 wherein each bracket includes a slot, each single body being pivotably connected to the bracket by a pin, the pin being linearly translatable in the slot, and further including resilient means biasing each pin toward one end of the slot to urge each single body towards the endless belt.

14. The multifunction apparatus of claim 12 wherein the first head is a brush adapted for brushing snow and the second head is a scraper adapted for scraping ice.

15. The multifunction apparatus of claim 12 further comprising a cover selectively connectable to first and second sides of the support frame, the first and second sides of the support frame exposing opposing segments of the endless belt, respectively, the cover adapted to cover one of the opposing segments of the endless belt.

16. The multifunction apparatus of claim 15 further comprising a movable shroud connected to the support frame between the handle and the endless belt, the movable shroud having first and second positions corresponding to the position of the cover for deflecting debris.

17. The multifunction apparatus of claim 12 wherein the handle is selectively rotatable on the support frame between left and right handed positions to allow for left handed and right handed users, the handle adapted to be locked into the left and right handed positions.

18. A surface engaging device assembly for use with a motorized multifunction apparatus for engaging a surface, the multifunction apparatus including a movable carrier, the surface engaging device comprising:

a body having first and second heads for engaging a surface, the body having a pivot axis;

a mounting bracket connectable to the movable carrier, the body being pivotably connected to the mounting bracket, the body being pivotable between a first position in which the first head project outward from the bracket for engaging a surface and a second position in which the second head projects outward from the bracket for engaging a surface;

wherein the mounting bracket includes a slot, the body being pivotably connected to the mounting bracket by a pin, the pin being linearly translatable in the slot, and further including resilient means biasing the pin toward one end of the slot.

19. The multifunction apparatus of claim 18 wherein the first head is a brush adapted for brushing snow and the second head is a scraper adapted for scraping ice.

* * * * *